US005502515A

United States Patent [19]

Sansalone

[11] Patent Number: 5,502,515

[45] **Date of Patent: * Mar. 26, 1996**

[54] DIVING MASK

[76] Inventor: Salvatore N. Sansalone, 12 Paradise Gardens, Bramalea, Ontario, Canada, L6S 5C7

[ * ] Notice: The portion of the term of this patent subsequent to Jul. 20, 2010, has been disclaimed.

[21] Appl. No.: 47,131

[22] Filed: Apr. 15, 1993

Related U.S. Application Data

[63] Continuation-in-part of Ser. No. 606,457, Oct. 31, 1990, Pat. No. 5,204,700, which is a continuation-in-part of Ser. No. 276,470, Nov. 25, 1988, abandoned.

[51] Int. Cl.[6] ..... G02C 1/00

[52] U.S. Cl. ..... 351/43; 351/41; 2/248

[58] Field of Search ..... 2/426, 428, 429, 2/430, 431, 439, 440, 441; 351/41, 43, 44

[56] References Cited

U.S. PATENT DOCUMENTS

| | | | |
|---|---|---|---|
| 2,928,097 | 3/1960 | Neufeld | 2/430 |
| 3,010,108 | 11/1961 | Sachs | 351/43 X |
| 3,055,256 | 9/1962 | Andresen | 351/43 |
| 3,672,750 | 6/1972 | Hagen | 351/43 |
| 5,204,700 | 4/1993 | Sansalone | 351/41 |

FOREIGN PATENT DOCUMENTS

| | | | |
|---|---|---|---|
| 574146 | 3/1958 | Italy | 2/428 |

OTHER PUBLICATIONS

Hecht, Eugene, *Optics,* 2nd Edition, Addison–Wesley Publishing Co., 1987, p. 136.

*Primary Examiner*—William L. Sikes
*Assistant Examiner*—Hung Xuan Dang
*Attorney, Agent, or Firm*—Shlesinger, Arkwright, Garvey

[57] ABSTRACT

A diving mask comprising: a supporting member arranged for sealing engagement with the face of the user; a lens means mounted in said supporting member, said supporting member being dimensioned, so that the lens means is positioned near the eyes of the user with a portion of the nose extending forwardly of the lens means to provide a low profile, low internal volume mask; and said lens means being substantially spherical in configuration and having a single center of curvature, whereby the apparent magnification of images underwater is less than that observed through a conventional lens plate.

20 Claims, 4 Drawing Sheets

DIVING MASK

This invention relates to diving masks and, more particularly, to a mask lens which permits virtually the same distortionless and widely peripheral vision in air to the diver in water, and is a continuation-in-part of application Ser. No. 07/606,457 filed Oct. 31, 1990, which is a continuation-in-part of application Ser. No. 07/276,470 filed Nov. 25, 1988, now abandoned.

BACKGROUND OF THE INVENTION

Prior attempts to make diving masks are best represented in U.S. Pat. No. 3,055,256 issued Sep. 25, 1962 to John H. Andreson, Jr., U.S. Pat. No. 3,672,750, issued Jun. 27, 1972 to Kenneth G. Hagen and U.S. Pat. No. 3,320,018 issued May 16, 1967 to Max H. Pepke. The Andreson U.S. Pat. No. '256 patent discloses a mask for divers with imperfect vision which includes a conventional mask frame in which is mounted a spherical lens, conventionally aligned.. The Hagen U.S. Pat. No. '750 patent discloses a diving mask with curved lenses for each eye, with a centre of curvature for each lens at the eyeball of the user. The Hagen mask should be custom made for each category of user to locate the specific eye points (e.g. optical centres and eye depth) properly; a universally acceptable mask cannot be made according to the teachings of Hagen. Further, it has been found that only slight shifting of the Hagen mask on the user's face distorts one's vision to such an extent that nausea may result. For this reason, then, such a diving mask is fundamentally unacceptable.

Pepke U.S. Pat. No. '018 is relevant at FIG. 20, showing a diving mask, again with spherical lenses having separate centres of curvature but located at the pupils of the eyes of the user, rather than at the centres of the eyeballs. The Pepke mask suffers the same deficiencies as Hagen's; the teachings of the Pepke patent cannot be used to produce a universally acceptable, distortionless vision mask but only individual masks, custom made for each category of diver user.

Remaining prior art disclosures are remote. U.S. Pat. Nos. 2,876,766 issued Mar. 10, 1959 to Dimitri Rebikoff et al and U.S. Pat. No. 3,010,108 issued Nov. 28, 1961 to Melvin H. Sachs illustrate diving mask lenses curved laterally and vertically. However, neither patent even remotely suggests a mask lens curvature specifically designed and configured to provide distortionless vision underwater. The distortions inherent in such unspecified curvatures have also been found to dangerously cause nausea to users. U.S. Pat. Nos. 2,952,853 issued Sep. 20, 1960 to Howard A. Benzel and U.S. Pat. No. 3,027,562 issued Apr. 3, 1962 to James K. Widenor are more remote and simply show diving masks curved in a single plane only; vision distortion is only exacerbated by such a construction, not alleviated. U.S. Pat. No. 3,483,569 issued to Israel Armendariz is similar. Again, the safety-threatening condition of diver nausea is inherent in these designs.

More exotic disclosures of attempts to provide magnification-free underwater vision are provided by U.S. Pat. Nos. 3,040,616, issued Jun. 26, 1962 to George R. Simpson and U.S. Pat. No. 4,373,788 issued Feb. 15, 1983 to M. Linton Herbert. These patents disclose dual 'focal point' lenses structures with air chambers behind the lenses in the former patent and a filling and draining bladder structure in the latter to permit readjustment of several lenses. Clearly, both designs are unfavourably complex and impractical.

Other prior art disclosures directed to attempt to improve certain aspects of underwater vision and/or provide diving mask myopia-correction lenses include U.S. Pat. Nos. 2,928,097 issued Mar. 15, 1960 to Lester N. Neufeld, U.S. Pat. No. 3,051,957 issued Sep. 4, 1962 to Chester C. Chan and French Patent No. 1,374,010 issued Aug. 24, 1964 to Jean-Louis Marro and an article entitled "Visual Problems of Skin Diving" by James R. Gregg, Skin Diver Magazine, April 1961, reprinted in The Optometric Weekly, Jul. 13, 1961, pp. 1381–1388.

What the prior art fails to disclose is a diving mask having a lens configured to provide substantially distortion free underwater vision, a major portion of the mask lens being curved so that the apparent magnification of images underwater is less than that observed through a conventional, flat lens plate, certain portions of the lens being further curved to eliminate or mitigate pincushion-type distortion. Further, the prior art also fails to disclose an improved application for a simple spherical mask lens which is incorporated into a skirt narrow enough to allow the user's nose to extend forwardly of the lens and whereby the optical axis is tilted in a forward vertical plane.

OBJECTS AND SUMMARY OF THE INVENTION

According to the present invention, there is provided an underwater vision device, comprising: a supporting member arranged for sealing engagement with the face of a user; a lens means mounted in said supporting member, said lens means having an optical surface; characterised by said lens means being generally curved so that multiple radii of curvature are incorporated on said optical surface such that the radius of curvature changes progressively with increasing distance away from one or more points on said optical surface.

According to another aspect of the invention, there is provided a diving mask comprising: a supporting member arranged for sealing engagement with the face of the user; lens means mounted in said supporting member, characterised by said supporting member being dimensioned so that the lens means is positioned near the face of the user with a portion of the nose extending forwardly of the lens means to provide a low profile, low internal volume mask and said lens means having an optical surface which covers both eyes of a user and has a curvature which is a section of a single spherical surface, whereby the apparent magnification of images underwater is less than that observed through a conventional lens plate.

Accordingly, it is a principal object of the invention to provide an enhanced peripheral vision mask or other underwater vision device having a faceplate lens major surface created from a specified aspherical, an ellipsoid or paraboloid configuration to improve underwater vision by reducing pincushion-type or barrel-type distortion and magnification.

It is a further object of the invention to provide a low volume, enhanced peripheral vision mask created from the combination of a narrow skirt which allows a portion of the user's nose to extend forwardly of a faceplate lens major surface created from a sphere configuration, the main optical axis of such sphere being tilted out of alignment in a forward vertical plane with respect to the general optical axis of forward-pointing eyes of the user.

It is another object of the invention to provide a diving mask having a faceplate lens curved in a predetermined manner so that vision underwater appears to be more closely similar to vision in air.

It is a further object of the invention to provide a diving mask having a faceplate lens of simplified, uncomplicated structure which is low in cost of manufacture yet provides substantially distortion free underwater vision.

It is yet a further object of the invention to provide an uncomplicated and substantially distortion-free magnifying dive mask.

BRIEF DESCRIPTION OF THE DRAWINGS

These, and further objects of the invention will become readily apparent by reference to the following detailed specification and drawings in which.

DESCRIPTION OF THE PREFERRED EMBODIMENTS

Figure 1:
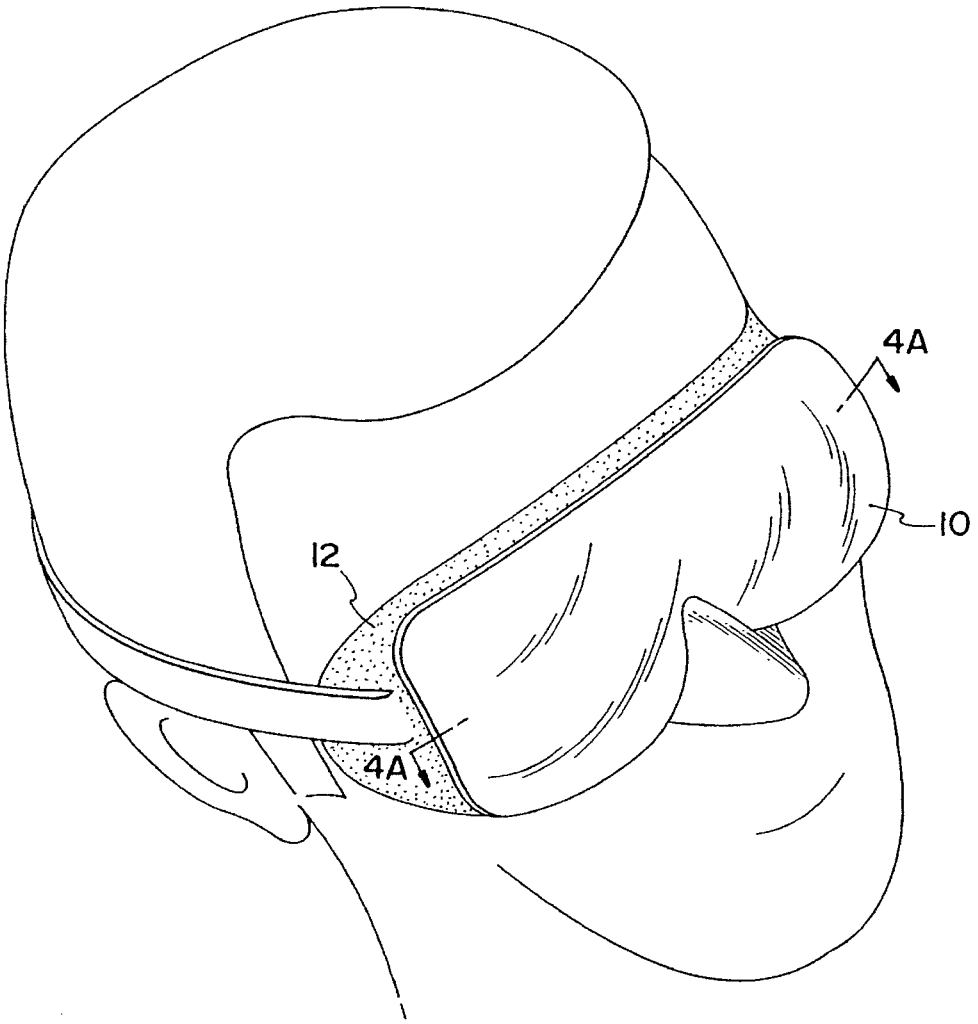
FIG. 1 is a perspective view of one embodiment of the invention being worn by a user.
Figure 2:
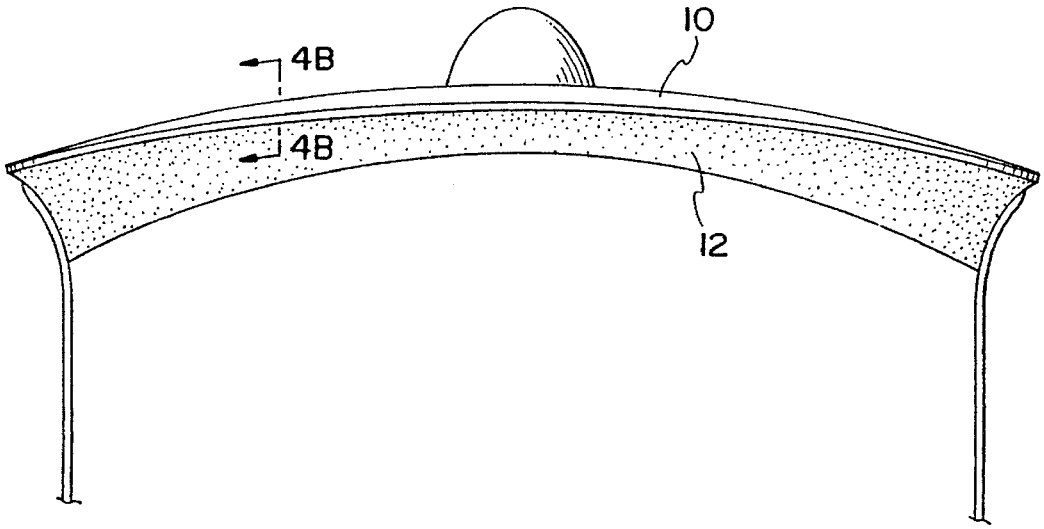
FIG. 2 is a top plan view of the diving mask shown in FIG. 1 and drawn to a larger scale.

Referring now to the drawings by reference character, and particularly FIGS. 1 and 2 thereof, an embodiment of the invention is shown including a simple faceplate lens 10 carried by a thin profile surrounding skirt 12. The low profile of skirt 12, with a portion of the user's nose extending forwardly of the lens, combined with curved faceplate lens 10 provides a streamlined mask of low internal volume. Also, the construction permits the lens 10 to be as close to the face and eyes of the user as comfort and practicality will permit, so that peripheral vision is further enhanced in part by expected mathematical effect. In the case of simple spherical lenses, however, there is noted an additionally further, unexpected, disproportionate, geometrically synergistic effect which plays an extended role of enhancing peripheral vision beyond the relevant prior art teachings.

Faceplate lens 10 may be made from material generated from any one of a wide variety of geometric shapes. Unlike prior art faceplate lenses, it has been found possible to create a lens which is virtually distortion free and substantially devoid of pincushion-type or barrel-type distortion. Pincushion distortion occurs as the field of vision is viewed anywhere except generally straight ahead and increases as the field is viewed farther and farther from generally straight ahead. For example, parallel straight lines, horizontal and vertical, appear to acquire increasingly more distance between them with increasing distance from field of view's central portion.

It has long been desired to create an acceptable dive mask wherein vision underwater appears the same as unobstructed in air, in other words, a mask having a lens that reduces the magnifying effect of water viewed through the air inside the mask and at tile same time provides continuous and truly substantial peripheral vision.

Figure 3:
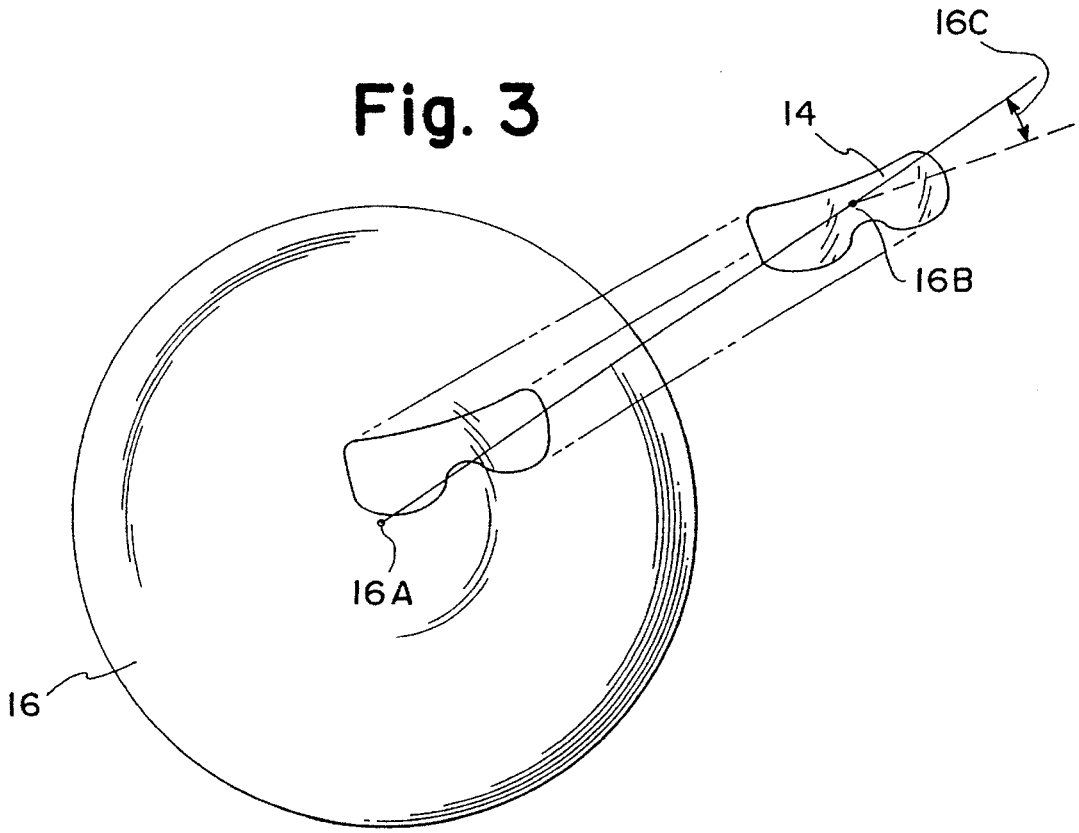
FIG. 3 is a perspective view showing the generation of a diving mask faceplate lens from a sphere, and the faceplate's subsequent tilting, in a forward vertical plane, out of alignment with the sphere's main optical axis, whereby the diver's normal forward vision would remain on the original axis.

With reference to FIG. 3, I have found that a suitable mask can be made by combining a narrow supporting skirt which positions the lens so that a portion of the user's nose extends forwardly from the lens, with a lens of transparent material created from a spherical surface. Thus, a lens 14 is shown having a single radius of curvature across the entire surface thereof, the centre of curvature of the sphere being well behind the eyeballs of the user. This lens, in combination with the aforementioned new positioning is in direct contradistinction to prior art dive masks which are intended to eliminate the visual magnification present by being underwater, such masks teaching either dual curved lenses having centres of curvature at the centres of the user's eyeballs or at the user's pupils, or in another example the single curved lens failing to be combined with the peripheral-vision-enhancing positioning described above, which produces an unexpected, disproportionate and synergistic geometrical effect. (In a computer model, for instance, found that an average user, whose eyes possess 70 mm optical centres, would receive only a 7° per side angular increase of spherical over flat side peripheral vision in the case of a larger volume mask where pupil-to-lens distance is 2.2" to keep the user's nose behind the lens. Unexpectedly, however, it was found that the same user and lens type configured in a low-volume mask with the user's nose protruding forwardly of the lens and a pupil-to-lens distance of 1.0" gains, not 7°, but 13° disproportionately more increase in side peripheral vision, or a total of 26° for both sides. Geometrically speaking, this occured because the low-volume mask's eyepoint is more perpendicularly placed in relation to the middle point of the window of angular increase provided by a spherical lens over flat, titus effectively widening such a window.) In a preferred embodiment, the radius of curvature of the sphere 16 will be in a range of from five to about seventeen inches or more and, more preferably, on the order of about nine-to-twelve inches. This provides a diving mask lens wherein the user appears to see objects underwater much the same as he would in air, without the typical magnification created by the fact that the index of refraction of water is about 1.33 whereas that of air is 1. A further finding with relation to the simple spherical lens, with centre of curvature 16A in the drawing, is that, despite the common practice of ensuring uniform alignment in an optical system, it is possible to gain advantage by tilting the mask lens in a forward vertical plane out of parallel alignment with the main optical axis, line 16A–16B, while the general optical axes of forward-pointing eyes of the user remain parallel to the original axis line 16A–16B. This produces further meaningful gains in field-of-view and yet appears, unexpectedly, to not upset user eye comfort as long as certain conditions are met, including, firstly, the forward vertical plane tilting is kept under the limit of approximately 5°–25°, represented in the drawing as angle 16C, and, secondly, no tilting occurs in a horizontal plane in order to preserve a common eye-to-lens distance for both left and right eyes of the user, and, thirdly, the radius of curvature of the lens remains greater than approximately 5½".

Figure 4A:
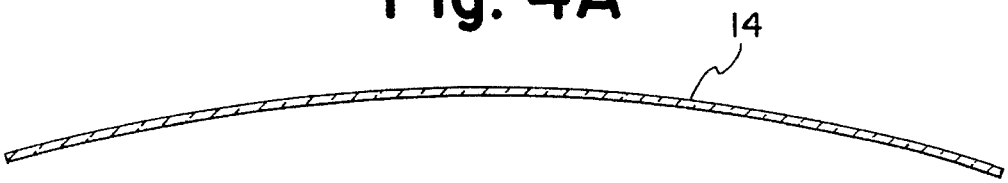
FIGS. 4A and 4B are lateral and vertical section views, respectively, taken through a lens generated from a sphere and taken along Lines 4A—4A and 4B—4B of FIGS. 1 and 2 respectively.
Figure 4B:
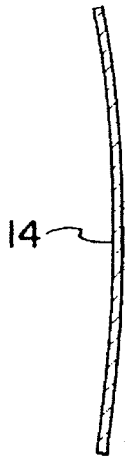

FIGS. 4A and 4B illustrate such a lens 14 horizontal and vertical cross-section.

Figure 5A:
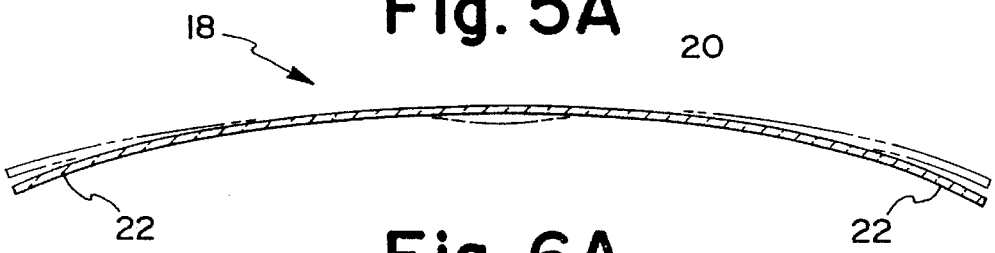
FIGS. 5A and 5B are section views similar to FIGS. 4A and 4B, showing a lens generated from an aspherical configuration such as, for example, specific-radius spherical in the centre and a smaller radius/radii group towards the edge portions.
Figure 5B:
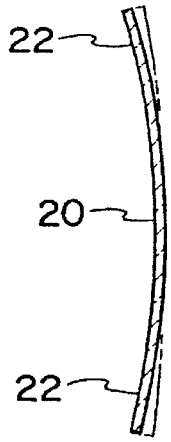

FIGS. 5A and 5B, similar to FIGS. 4A and 4B, illustrate an even more satisfactory lens surface 18 wherein, for example, a central, major portion 20 is spherical and the outer, upper and lower edges become specified aspherical or ellipsoidal in configuration as is indicated at 22. This more pronounced curvature at portions 22 (as compared with the spherical surface illustrated by the dotted lines in FIG. 5A) assists in reducing the pincushion-type distortion phenomenon discussed above. These views also illustrate that the lens 20 could alternatively be generated as an aspherical surface of specified, incrementally decreasing radii beginning from a centre point (as illustrated by the sectioned surface of FIG. 5A) or centre points (where FIG. 5A, with the central portion of the surface modified to incorporate the dashed lines of the figure, illustrates an aspherical surface with incrementally decreasing radii beginning from two principle points).

Figure 6A:
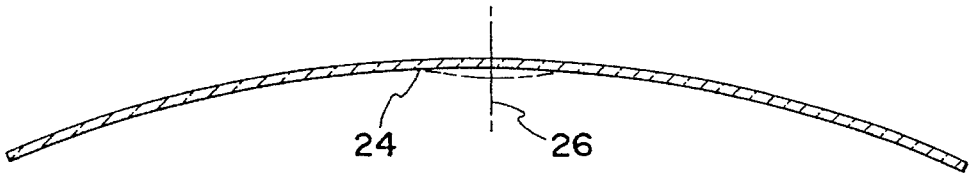
FIGS. 6A and 6B are section views similar to FIGS. 4A and 4B showing a lens generated either from an ellipsoid or other aspherical surface having a similarly decreasing radius of curvature outwardly from a centre point or points.
Figure 6B:
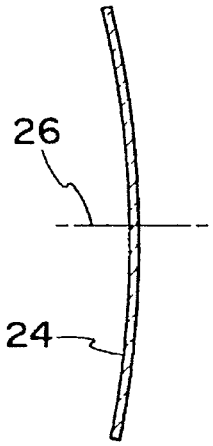

FIGS. 6A and 6B, similar to FIGS. 4A and 4B, show a lens 24 generated from an ellipsoidal surface; such a lens also assists in reducing the pincushion distortion phenomenon. These views also illustrate that the lens 24 could alternatively be generated as an aspherical surface of specified, incrementally decreasing radii, beginning from a centre axis 26 or central point or points, the latter of which is illustrated in dashed lines in FIG. 6A. In any event, pincushion distortion is reduced in lenses 20 and 24 because the angles of incidence of incoming light rays, particularly from the direction of the more peripheral areas of the faceplate lens, are closer to being at right angles to tangents drawn at the lens surface than is the case with single-radius spherical lenses and conventional flat faceplate lenses of any readily available diving mask. Also, the outer areas of reduced radius provide a further reduced image size in those areas which effect appears to also contribute in reducing pincushion distortion.

Figure 8:
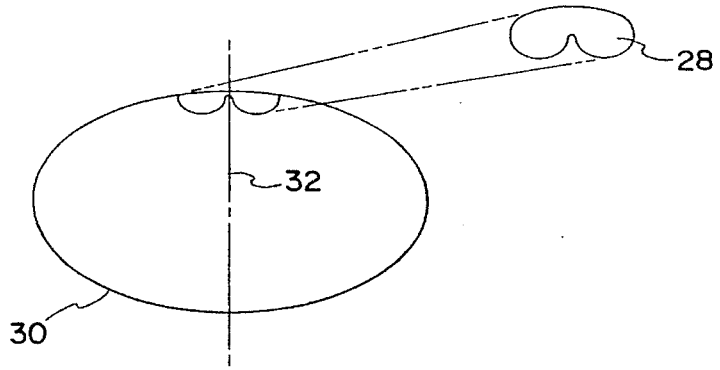
FIGS. 8, 9 and 10 are perspective, diagrammatic views showing generation of a faceplate lens from a short axis ellipsoid, long axis ellipsoid and paraboloid, respectively.
Figure 9:
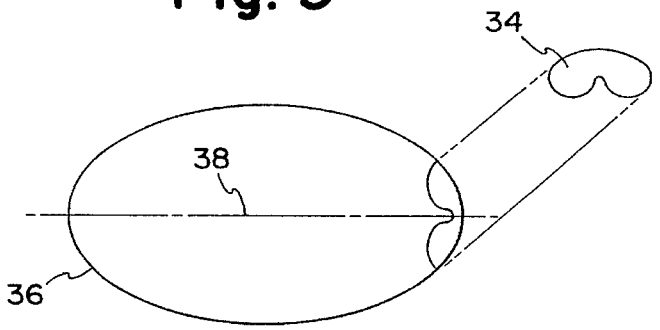
Figure 10:
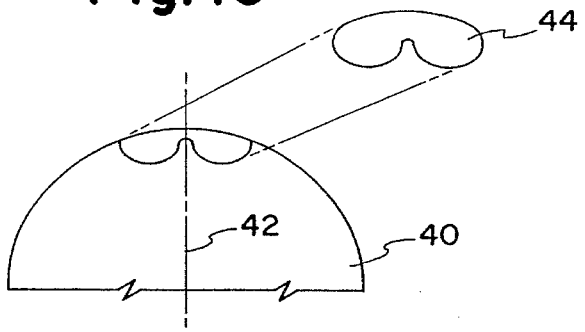

Turning now to FIGS. 8, 9 and 10, faceplate lenses generated from other geometric forms are illustrated. FIG. 8 illustrates a lens 28 generated from the surface of an ellipsoid 30 created by rotating an ellipse about its short axis 32. Here, it should be noted that the lens may be taken radially from the axial portion of ellipsoid 30 so that curvature of the lens away from its centre axis (e.g., 32, FIG. 8) is uniform.

In FIG. 9 a lens 34 is generated from the surface of an ellipsoid 36 created by rotating an ellipse about its long axis 38. In this case, the lens may be taken radially from the long rather than short axial portion of ellipsoid 36 as is roughly illustrated.

In FIG. 10, the surface is a paraboloid 40 created by rotating a parabola about is axial centreline 42 and the lens 44 may be taken from the axial portion of paraboloid 40 as is roughly illustrated.

Figure 7:
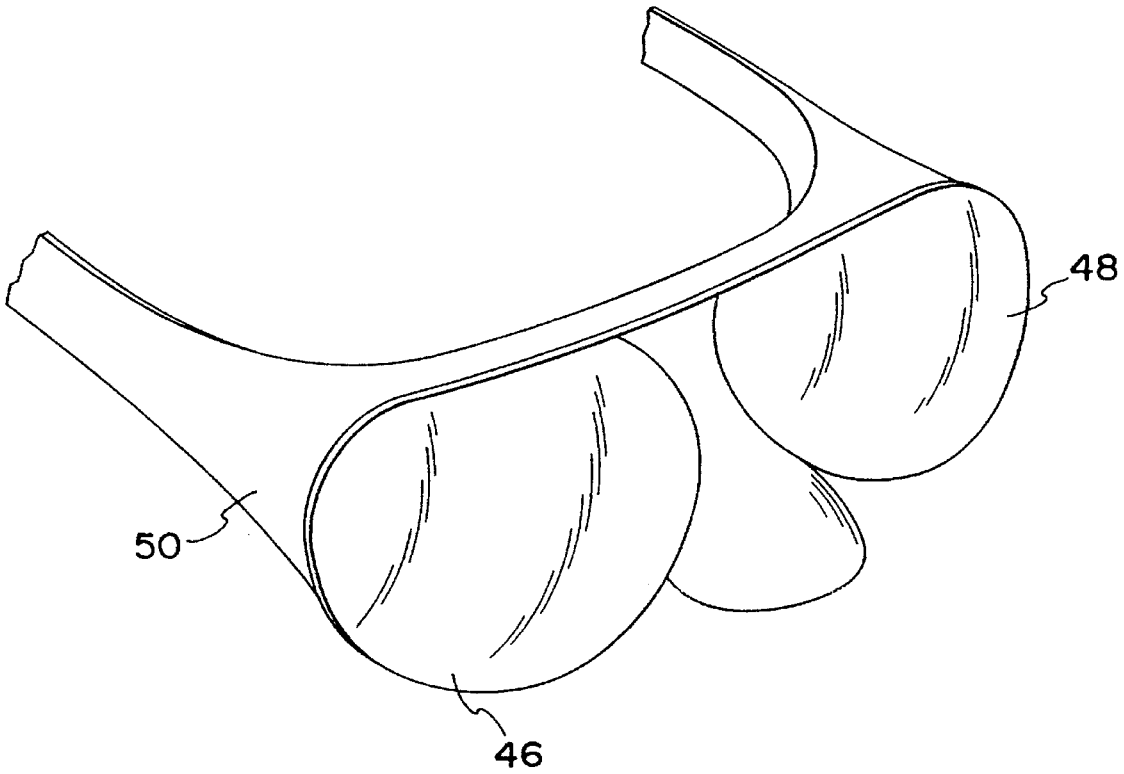
FIG. 7 is a perspective view of another embodiment of the invention.

FIG. 7 illustrates another embodiment of the invention comprising a pair of faceplate lenses 46, 48 mounted in a mask skirt 50. Preferably, lenses 46 and 48 are generated from a continuous smooth curved surface as in embodiments discussed above. If generated by a spherical surface, lenses 46 and 48 will have the same radius of curvature and common centre of curvature, somewhat behind the eyes of the user.

Figure 11:
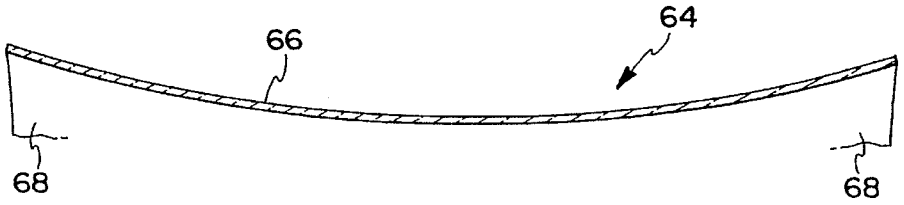
FIG. 11 is a largely diagrammatic view of a magnifying diving mask with a specified aspherical surface where radius of curvature generally increases towards the edges, for example, paraboloid-type.

A magnifying dive mask 64 is illustrated in FIG. 11, including a faceplate lens 66 in a frame 68, which lens may be selected from any of the lenses of the previously described embodiments except spherical, but is mounted in reverse, so that the convex surface of lens 66 is adjacent the user's face, rather than the concave side as in the previous embodiments. Distortion can be mitigated in this type of mask by selecting a lens which possesses multiple radii of curvature where the radii lengths generally increase with increasing distance away from a central point or points, as in a paraboloid, for instance.

In all of the embodiments discussed, preferably the lens material is of uniform thickness but in certain applications it may be desirable to vary the material thickness and/or composition. Also, it is desired that the lens structure be rather rigid so that predetermined visual properties of any selected lens are not varied or altered by bending, e.g., when a mask is placed on the face of the user.

While the present invention has been shown and described as applied to a diving mask, it is to be understood that it may also be incorporated in a diving helmet, a full face diving mask, or other underwater vision/optical device for divers.

While this invention has been described as having a preferred design, it is understood that it is capable of further modifications, uses and/or adaptations of the invention and following in general the principles of the invention and including such departure from the present disclosure as come within known or customary practice in the art to which the present invention pertains, and as may be applied to central features herein before set forth, and fall within the scope of the invention or the limits of the claims appended hereto.

I claim:

1. An underwater vision device, comprising:

a) a supporting member arranged for sealing engagement with the face of a user;

b) a lens means mounted in said supporting member, said lens means having an optical surface;

c) said lens means being generally curved so that multiple radii of curvature are incorporated on said optical surface such that the radius of curvature changes progressively with increasing distance away from one or more points on said optical surface; and d) the radius of curvature increasing progressively with increasing distance away from one or more predetermined central points on said optical surface in order to reduce overall lens distortion.

2. The underwater vision device of claim 1, wherein:

a) said optical surface comprises a section from an ellipsoidal surface generated from an ellipse, said optical surface centered about the long elliptical axis of said ellipse, whereby the radius of curvature of said optical surface increases progressively with increasing distance away from the point on said optical surface represented by the intersection of said elliptical axis with said optical surface.

3. The underwater vision device of claim 1, wherein:

a) said lens means comprises a section from a paraboloidal surface, said optical surface centered about the axis of said paraboloidal surface, whereby the radius of curvature of said optical surface increases progressively with increasing distance away from the point on said optical surface represented by the intersection of said axis with said optical surface.

4. A diving mask comprising:

a) a supporting member arranged for sealing engagement with the face of a user;

b) lens means mounted in said supporting member;

c) said supporting member being dimensioned so that said lens means is positioned near the face of the user with a portion of the nose extending forwardly of the lens means;

d) said lens means having an optical surface which covers both eyes of a user and has a curvature which is a section of a single spherical surface, whereby the apparent magnification of images underwater is less than that observed through a conventional lens plate; and e) said supporting member mounts said lens means so that the center of said optical surface of said lens means is, in use, tilted away from the eyes of the user so that a radial axis passing through the center of said central optical surface inclines toward the eyes of the user.

5. The diving mask of claims 4, wherein:

a) the length of the radius of curvature of said optical surface is in excess of 5 inches such that the center of curvature of said optical surface is well behind the eyes of the user.

6. The diving mask of claims 5, wherein:

a) the length of said radius is approximately 10 inches.

7. The diving mask of claim 5, wherein:

a) said lens means comprises two lenses, one covering each eye of the user.

8. The diving mask of claim 4, wherein:

a) said optical surface comprises a central portion of said lens means; and b) said lens means comprises a peripheral optical surface having a smaller radius of curvature than said central optical surface.

9. The diving mask of claim 4, wherein:

a) said central radial axis is, in use, declined from 5 to 25 degrees from a neutral orientation whereat said central axis is not inclined toward either the eyes or the nose of the user.

10. The diving mask of claim 4, wherein:

a) said lens means comprises a single lens which, in use, covers both eyes of the user.

11. A diving mask comprising:

a) a supporting member arranged for sealing engagement with the face of a user;

b) lens means mounted in said supporting member; and c) said supporting member being dimensioned so that said lens means is positioned near the face of the user with a portion of the nose extending forwardly of the lens means; and d) said lens means having an optical surface which covers both eyes of a user and has a curvature which is a section of a single spherical surface with a radius of curvature up to about 12 inches, whereby the apparent magnification of images underwater is less than that observed through a conventional lens plate.

12. The diving mask of claims 11, wherein:

a) the length of the radius of curvature of said optical surface is in excess of 5 inches up to about 12 inches such that the center of curvature of said optical surface is well behind the eyes of the user.

13. The diving mask of claims 11, wherein:

a) the length of said radius is approximately 10 inches.

14. The diving mask of claim 11, wherein:

a) said optical surface comprises a central portion of said lens means; and b) said lens means comprises a peripheral optical surface having a smaller radius of curvature than said central optical surface.

15. The diving mask of claim 11, wherein:

a) said supporting member mounts said lens means so that said central optical surface of said lens means is, in use, tilted away from the eyes of the user so that a radial axis passing through the center of said central optical surface inclines toward the eyes of the user.

16. The diving mask of claim 11, wherein:

a) said central radial axis is, in use, declined from 5 to 25 degrees from a neutral orientation whereat said central axis is not inclined toward either the eyes or the nose of the user.

17. The diving mask of claim 11, wherein:

a) said lens means comprises a single lens which, in use, covers both eyes of the user.

18. The diving mask of claim 11, wherein: a) said lens means comprises two lenses, one covering each eye of the user.

19. An underwater vision device, comprising:

a) a supporting member arranged for sealing engagement with the face of a user;

b) a lens means mounted in said supporting member, said lens means having an optical surface;

c) said lens means being generally curved so that multiple radii of curvature are incorporated on said optical surface such that the radius of curvature changes progressively with increasing distance away from one or more points on said optical surface;

d) the radius of curvature decreasing progressively with increasing distance away from one or more predetermined central points on said optical surface in order to reduce overall lens distortion; and e) said optical surface comprising a section from an ellipsoidal surface generated from an ellipse, said optical surface centered about the short elliptical axis of said ellipse, whereby the radius of curvature of said optical surface decreases progressively with increasing distance away from the point on said optical surface represented by the intersection of said elliptical axis with said optical surface.

20. The diving mask of claim 9, wherein:

a) said lens means comprises two lenses, one covering each eye of the user.

* * * * *